US005315718A

United States Patent [19]

Barson et al.

[11] Patent Number: 5,315,718

[45] Date of Patent: May 31, 1994

[54] PROTECTIVE HELMET AND RETENTION SYSTEM THEREFOR

[75] Inventors: John V. Barson, Fort Rucker, Ala.; Roger J. Croft, Farnborough, United Kingdom

[73] Assignee: The United States of America as represented by the Secretary of the Army, Washington, D.C.

[21] Appl. No.: 876,537

[22] Filed: Apr. 30, 1992

[51] Int. Cl.[5] ..... A42B 1/22

[52] U.S. Cl. ..... 2/418; 2/421; 2/6.1

[58] Field of Search ..... 2/6, 411, 412, 414, 2/417, 418, 421, 423, 424, 425, 410, 6.8, 415, 420

[56] References Cited

U.S. PATENT DOCUMENTS

| | | | |
|---|---|---|---|
| 4,006,496 | 2/1977 | Marker | 2/414 |
| 4,075,715 | 2/1978 | Cowgill | 2/421 |
| 4,432,099 | 2/1984 | Grick et al. | 2/414 |
| 4,534,068 | 8/1985 | Mitchell et al. | 2/414 |
| 4,627,114 | 12/1986 | Mitchell | 2/414 |
| 4,884,301 | 12/1989 | Aileo | 2/6 |
| 5,056,162 | 10/1991 | Tirums | 2/412 |

*Primary Examiner*—Clifford D. Crowder
*Assistant Examiner*—Michael A. Neas
*Attorney, Agent, or Firm*—John H. Lamming; Arthur H. Tischer

[57] ABSTRACT

A protective helmet has a fitting and retention system which allows for fitting a variety of head sizes and shapes with a single helmet size and also allows for precision reproducible fitting for a repeat user. The protective helmet has an energy-attenuating liner comprising a brow pad, a crown pad and a floating occipital pusher plate. The pusher plate hangs from the rear of the helmet on adjustable straps which are tensioned to urge the wearer's head forward toward the front of the helmet. This ensures that weapon sighting/designation systems are consistently aligned each time the helmet is worn. This feature also allows the helmet to accommodate a variety of head sizes and shapes. Pusher plate movement is preferably controlled using a parallel arrangement of two horizontal straps in which the lower strap is adjusted as part of the chinstrap assembly while the upper strap routed through a slot in the helmet shell and coupled to a device which simultaneously tensions the pusher plate and the ear cups.

8 Claims, 3 Drawing Sheets

PROTECTIVE HELMET AND RETENTION SYSTEM THEREFOR

BACKGROUND OF THE INVENTION

1. Technical Field

The present invention relates to protective helmets and in particular to an improved helmet retention system which provides a secure and consistent fit of such helmets for a wide variety of head shapes and sizes.

2. Background Information

Protective headgear is widely used in military applications not only to provide protection against impact hazards, but also to safeguard the wearer against the effects of excessive noise. It is well known that the protection conferred by a properly fitted helmet is superior to that obtainable from a loosely fitting one. In recent years this requirement for secure fitting has assumed even greater importance, since the protective helmet in many of its applications has acquired a secondary role as an integral part of sophisticated weapons systems. Such systems involve the addition to the helmet of head-mounted sighting/designation equipment which inevitably causes a shift in the helmet's center of gravity. This in turn leads to an increased tendency for the helmet to move in relation to the wearer's head. Any movement of this kind is regarded as undesirable lest it cause a loss of bore sight, i.e., a loss of alignment between the optical axis of the sighting system (on the aircraft) and the optical axis of the display system (on the helmet). It is vital that helmet-mounted equipment should fit onto the wearer's head in the same precise location each time the helmet is donned. Equally, the helmet must not slip as a result of the changing gravitational forces encountered during flight or when traversing bumpy terrain.

The fitting of a helmet which includes a sighting-/designation system can take a skilled technician many hours and even more time can be spent during a refit if use of the helmet is contemplated in combination with a chemical protective respirator. It is probable that military operations in remote locations will limit the availability of such technicians, thereby making the initial fit and any subsequent refit of the helmet very difficult.

The majority of helmet fitting systems are based on the use of either webbing strap and pad combinations, or else filler materials are used such as polyurethane foam to center the head of the wearer in the helmet shell. In some systems thermoplastic filler materials are used which are molded to the head shape of an individual wearer. Unfortunately, this centering operation can result in an increase in separation between the wearer's eyes and the image display such that the wearer's field of view through the sighting/designation system is reduced.

By contrast, the fitting system of the present invention works by urging the wearer's head forward so that it is pushed firmly against the brow piece inside the helmet. Preferably, the ear cups are simultaneously urged inwards to firmly engage the sides of the wearer's head in order to minimize side-to-side movement of the helmet. The first of these two operations is essential to ensure that the wearer's eyes are positioned as far forward as possible and fall within the exit pupil of the sighting/designation equipment, and also to ensure that the wearer's head is returned to the same relative position each time the helmet is donned. This consistency in positioning of the head is the key to obtaining greatest possible accuracy from helmet-mounted sighting/designation equipment.

Circumstances may also arise in which it is necessary for non-military personnel to wear a protective helmet in order to perform a specific task, for example when airlifting emergency medical personnel by helicopter to the scene of an accident. In these circumstances it is unlikely that the personnel called upon will possess their own helmets, yet it is desirable that they should be equipped with helmets having a good fit. It is equally unlikely that the helicopter reserve equipment will include a variety of helmets in different sizes, since these would not only take up a great deal of space but would also contribute unnecessary weight to the aircraft.

It is an object of this invention to alleviate some of the drawbacks of known helmets by providing a helmet having an improved retention and fitting system which gives a reliable and stable fit without requiring intervention by skilled technicians and which can be adjusted for varying conditions without compromising the protective capabilities of the helmet or the accuracy of its sighting/designation equipment if such is fitted. It is also an object of this invention to provide a helmet having a retention and fitting system which can be adjusted by a non-expert to variations in wearers' head dimensions so that a single helmet can be worn by a variety of users on different occasions.

SUMMARY OF THE INVENTION

The invention is a protective helmet comprising a helmet shell, ear cups and a chinstrap assembly, said helmet shell having an energy-attenuating liner which includes a brow pad and a crown pad, and which further includes an occipital pusher plate suspended from the inside rear aspect of the helmet shell on adjustable strap means, said occipital pusher plate being operable to urge a wearer's head towards the front of the helmet on tensioning of a strap means.

In a preferred form of the invention, adjustment of the occipital pusher plate is controlled from a parallel arrangement of two horizontally-disposed straps. In this arrangement, the lower strap is adjustable as part of the chinstrap assembly and controls the position of the lower aspect of the pusher plate. The upper strap is routed to the exterior of the helmet through a slot in the helmet shell, where it is coupled to a tensioning device which adjusts the position of the upper aspect of the pusher plate. In an alternative arrangement, the upper strap can be tensioned using an internal tensioning device so that it remains within the interior of the helmet shell, thus avoiding external routing.

The upper strap is integrated with the ear cup suspension such that tensioning of the upper strap causes simultaneous tensioning of the ear cups, bringing them into firm engagement with the wearer's ears and hence reducing the opportunity for side-to-side movement of the helmet.

The occipital pusher plate is attached to the rear lip of the helmet shell by a flexible loop which prevents it from riding up when the helmet is donned.

Preferably, the crown pad is substantially rectangular in shape, having rounded corners and a maximum width which permits air flow around the sides of the wearer's head for ventilation and therefore greater comfort. A preferred crown pad is made from a layered composite of expanded polyethylene and open cell foam and extends from the anterior cranial region to the posterior cranial region of the wearer's head with its major curvature in the sagittal (anterior-posterior) plane and a lesser curvature in the coronal (side-to-side) plane. This configuration offers the advantage of providing a sufficiently large surface area of contact for supporting the helmet on the top of the head for a wide range of head sizes while maintaining the proper eye pupil position with respect to the upper rim of the helmet face aperture.

The expanded polyethylene element of the crown pad is preferably of uniform thickness over its entire area, though it may be tailored to suit the particular helmet style to which it is attached. The open cell foam element has a maximum thickness of 6 mm (approximately 0.25 inch) to prevent dynamic overshoot and overlies the expanded polyethylene element such that it lies nearest the wearer's head. The entire head-facing surface of the composite crown pad may be provided with a textile covering such as a brushed nylon cloth.

The combination of the occipital pusher plate and the preferred composite crown pad assembly allows a wide range of pupil vertex heights to be accommodated, for the following reasons. First, tensioning of the occipital pusher plate serves to fix the position of the wearer's forehead in relation to the brow pad. This compresses the brow pad and thereby minimizes problems associated with dynamic overshoot. Second, the crown pad is brought into contact with the upper part of the forehead. Crown pad contact then extends superiorly over the sagittal suture region of the head and the open cell foam becomes compressed so as to fill in any gaps and provide a slight cushioning effect over any protruberances in the skull. The expanded polyethylene element of the crown pad has sufficient resilience to conform slightly to the longitudinal and coronal curvatures of the head while retaining its impact protective properties.

Although the surface area contact between the crown pad and the head will vary between individuals according to head shape and size, through a combination of contour, shape and composition, the preferred crown pad achieves a self-positioning minimum area of contact of 120 $CM^2$ (approximately 18 $in^2$).

BRIEF DESCRIPTION OF THE DRAWINGS

The invention will now be described by way of a detailed description with reference to the drawings, in which.

DETAILED DESCRIPTION OF THE INVENTION

In the text which follows, relative spatial terms such as left, right and horizontal are to be interpreted as referring to a user's perspective when wearing the helmet with the head in a substantially upright position.

Figure 1:
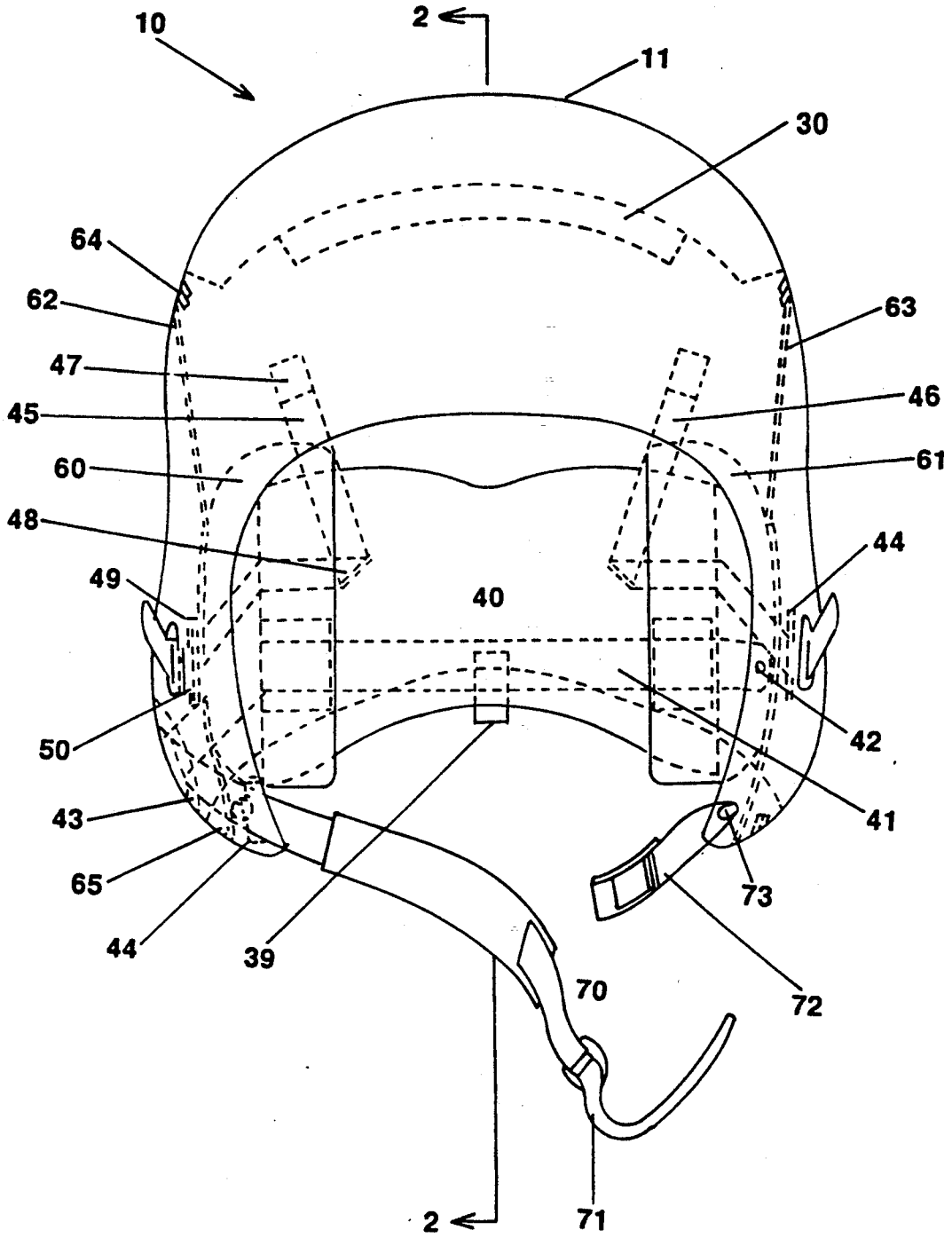
FIG. 1 is a front perspective view of a helmet of the invention showing some features inside the helmet by means of dotted lines.

Referring now to FIG. 1, there is shown a helmet generally represented as 10, which comprises a shell portion 11, ear cups 60 and 61, and a chin strap assembly 70. The shell 11 has an energy-attenuating liner comprising a brow pad (20, shown in FIG. 2), a crown pad 30 and a floating occipital pusher plate 40.

Typically, the brow pad 20 comprises a leather and foam pad mounted onto the helmet shell 11 using touch and close tape. The shape and thickness of the brow pad may vary as required to fit the interior of different types and sizes of helmets.

The crown pad 30 is constructed as a layered composite of expanded polyethylene and open cell foam, in which the layer closest to the wearer's head consists of an open cell foam pad of 6 mm (about 0.25 inch) thickness and the layer closest to the helmet shell 11 consists of an expanded polyethylene pad of 12 m thickness. The pad surface closest to the wearer's head is then covered with brushed nylon or similar textile material. Helmet height may be varied by incorporating additional crown pads as required. The shape of the crown pad may be varied as required to match the interior of different helmet types and sizes.

The occipital pusher plate 40 is also padded for comfort; its shape, thickness and flexibility may be varied to suit the particular helmet for which it is intended. The plate 40 is suspended from the rear aspect of the helmet shell 11 on a parallel arrangement of two horizontally-disposed straps which control its range of movement. In addition there is a flexible loop 39 which extends between the lower rear aspect of the pusher plate 40 and the rear lip of the helmet shell 11. This is useful in preventing the pusher plate from riding up when the helmet is donned.

The straps in the drawings are generally shown as being formed of a webbing material, but in some applications it may be more appropriate to use cord. Whatever the nature of the strap material, the same basic principles of operation apply, as described in detail below.

As seen in FIG. 1, the lower horizontal strap 41 has a fixed anchor 42 on the left inside aspect of the helmet shell and is routed to the rear of the inside of the helmet, around the outside of the lower rear aspect of the pusher plate 40. From here it extends around the right inside aspect of the helmet shell, through a low profile slotted pulley 43 and forward through a ring pulley arrangement 44, where the right side of the chinstrap 70 leaves the helmet shell 11. The free end of lower strap 41 thus forms the adjustable portion of 71 of the chinstrap 70. The fixed end 72 of the chinstrap is anchored to the left inside aspect of the helmet shell at 73.

Figure 3:
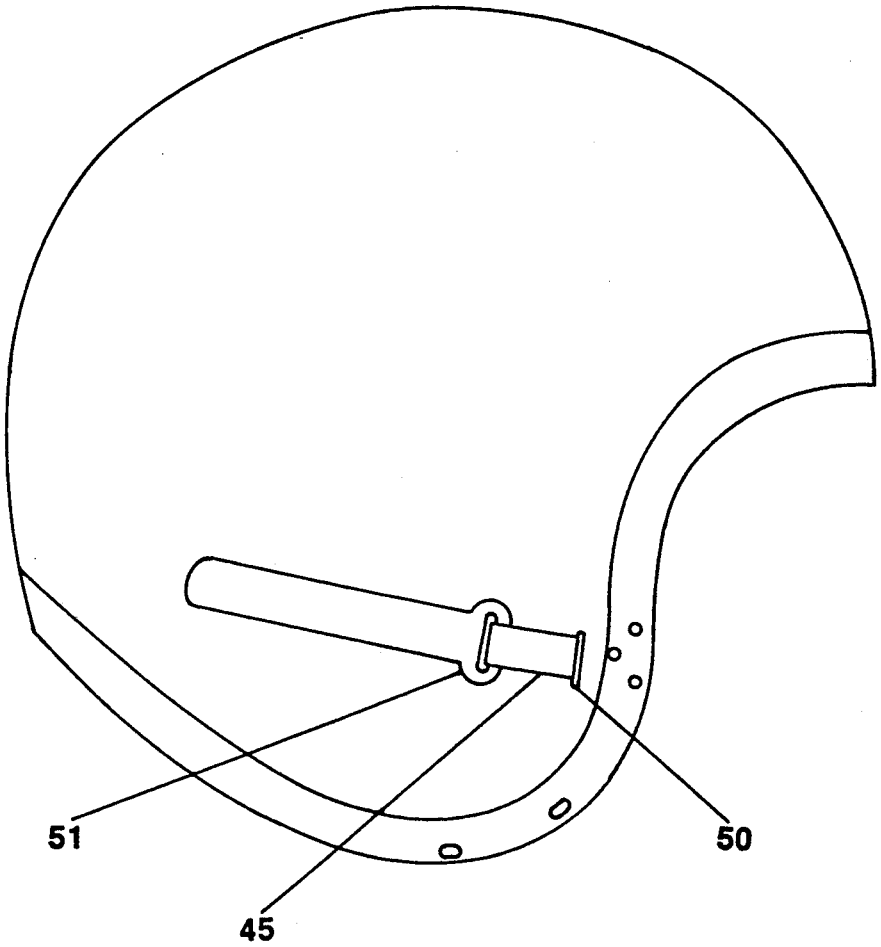
FIG. 3 is a side view of the right hand side of the helmet.

The upper horizontal strap assembly comprises a pair of straps 45 and 46, each configured as a mirror image of its partner. The right hand upper horizontal strap 45 depends from a fixed anchor 47 on the upper right aspect of the inside of the helmet shell 11 and is routed through a loop 48 on the upper right corner of the rear of the pusher plate 40. It then passes horizontally and laterally to the right inside aspect of the helmet shell 11, passing toward the front of the helmet around the outside of the right hand ear cup 60 and around a pulley 49 attached to oxygen mask hook base (not shown). The strap 45 is then guided horizontally through a slot 50 in the helmet shell 11 and doubles back in a rearward direction along the outside of the shell. Here it is connected to a tensioning device (see FIG. 3) such as a releasable ratchet buckle 51 which allows simultaneous tensioning of the right upper aspect of the pusher plate 40 and the right ear cup 60. Webbing strap 46 is similarly routed along the left hand side of the helmet and is operable to tension the upper left aspect of the pusher plate 40 and the left ear cup 61.

Figure 2:
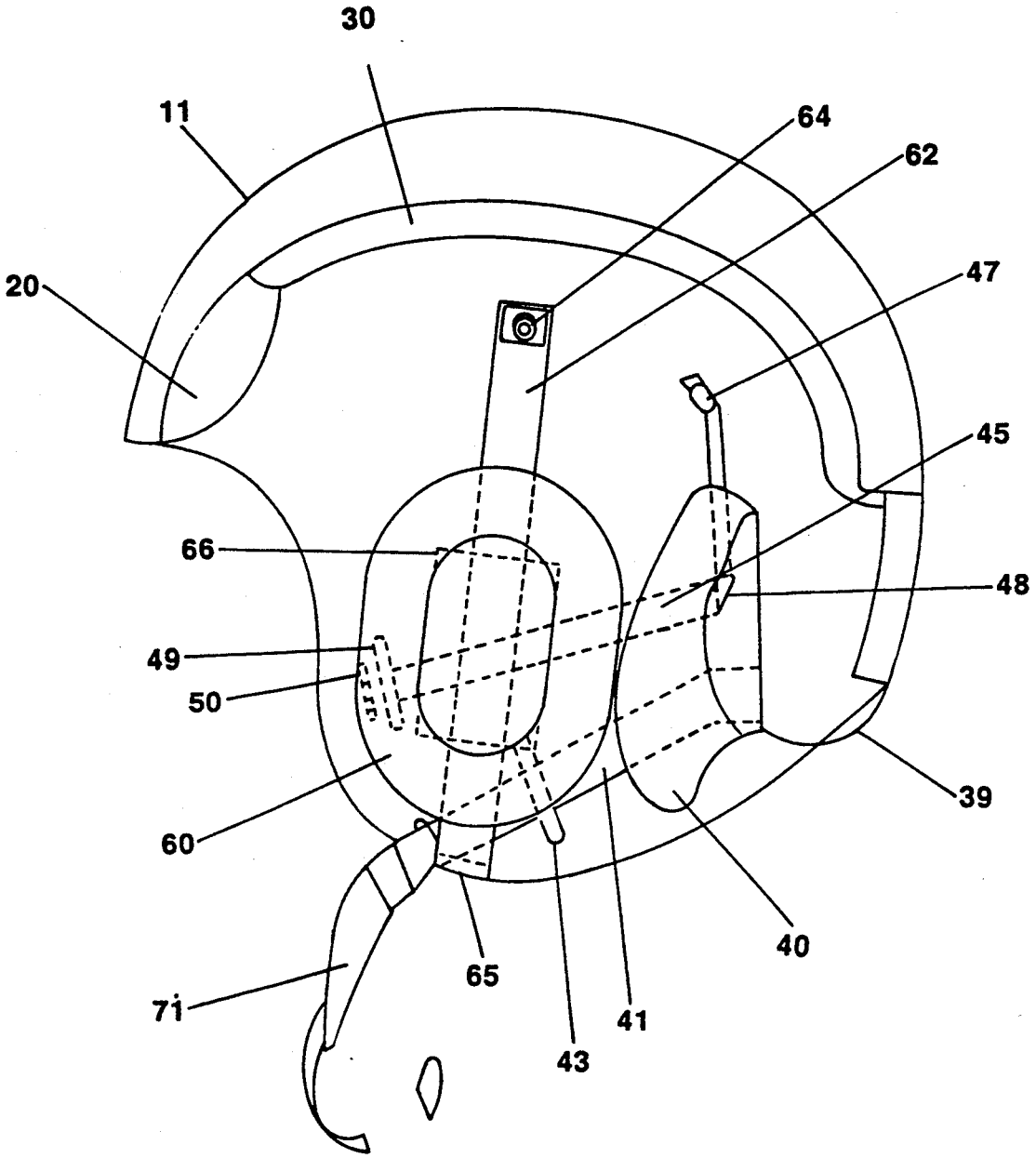
FIG. 2 is a section on line 2—2 of FIG. 1.

The ear cups 60 and 61 are each suspended from a respective elastic strap 62, 63 arranged vertically inside the helmet shell. As best seen in FIG. 2, the right hand elastic strap 62 is attached to the inside of the helmet shell 11 at upper and lower fixing points 64 and 65. A fabric ear cup mounting pad 66 is attached to the outside of right ear cup 60 using touch and close tape and is arranged to enclose the elastic strap 62 and the right hand horizontal strap 45 in a manner which allows relative sliding motion of the ear cup along the straps. This facilitates automatic positioning of the ear cups in register with the wearer's ears. The ear cups are each provided with a donning loop (not shown) attached to their lower edges.

To don the helmet, the wearer spreads the ear cups using the donning loops and rotates the helmet onto the head. The chinstrap buckle is fastened and the chinstrap tensioned by pulling on the free end 71 of the lower horizontal strap. This tensioning action not only adjusts the chinstrap, but also pulls the lower aspect of the occipital pusher plate 40 into firm engagement with the lower aspect of the back of the wearer's head. The upper horizontal strap arrangement is tensioned by pulling on the two side straps extending rearwardly along the outside of the helmet shell. This causes the upper aspect of the occipital pusher plate 40 to be urged forwards onto the back of the wearer's head and simultaneously pulls the ear cups toward their respective sides of the head to seal them against the wearer's ears. By this means, the wearer's head is urged against the helmet brow pad in a reproducible fashion.

Removal of the helmet is accomplished by first unfastening the chinstrap and then spreading the ear cups by means of the donning loops. The helmet can then be lifted and rotated forward from the head. If desired, the two side straps forming the upper horizontal strap arrangement can be loosened prior to helmet removal, though in practice this is seldom necessary.

Although the invention has been particularly described with reference to a specific arrangement of straps for adjustment of the occipital pusher plate, modifications of this arrangement may be apparent to those skilled in the art without departing from the scope of the claims which follow.

What is claimed is:

1. A protective helmet comprising:

(a) a helmet shell having a slot on either side to permit passage through it of a strap;

(b) one releasable strap tensioning means on either side of the helmet shell;

(c) two ear cups, each suspended on opposite sides of the helmet shell from an elastic strip placed substantially vertically and attached to the inside surface of the helmet shell at upper and lower fixing points;

(d) a chin strap assembly; and (e) an energy-attenuating liner for the helmet shell which includes a brow pad; at least one crown pad comprising a layered composite of expanded polyethylene and open cell foam in substantially rectangular shape which extends from the anterior cranial region to the posterior cranial region of a wearer's head, having major curvature in the saggital plane and lesser curvature in the coronal plane, and having a maximum width that permits air flow around the sides of a wearer's head for ventilation; and a floating occipital pusher plate suspended from the inside rear aspect of the helmet shell on adjustable strap means, said floating occipital pusher plate being operable to urge a wearer's head towards the front of the helmet on tensioning the adjustable strap means; wherein said adjustable strap means comprises an arrangement of two substantially horizontal straps on either side of the helmet shell consisting of an upper and a lower strap, the lower strap on either side being part of the chin strap assembly and the upper strap on each side being routed to the exterior of the helmet through its respective slot in the helmet shell where it is coupled to the releasable strap tensioning means.

2. The protective helmet of claim 1 wherein the upper strap portion of the adjustable strap means on either side of the helmet is routed around the outside of the ear cup on its respective side of the helmet shell such that tensioning of the upper strap on either side causes simultaneous tensioning of the ear cup on that side to bring the ear cup into firm engagement with a wearer's ear.

3. The protective helmet of claim 1 further comprising two fabric ear cup mounting pads, each of which is attached to the outside of an ear cup on each side of the helmet wheel with tape means, the mounting pads being arranged to enclose the elastic strap from which the ear cup is suspended and the upper strap of the adjustable strip means to allow automatic positioning of the ear cups in register with a wearer's ears.

4. The protective helmet of claim 2 further comprising two fabric ear cup mounting pads, each of which is attached to the outside of an ear cup on each side of the helmet shell with tape means, the mounting pads being arranged to enclose the elastic strap from which the ear cup is suspended and the upper strap of the adjustable strip means to allow automatic positioning of the ear cups in register with a wearer's ears.

5. A protective helmet comprising a helmet shell having a slot on either side thereof to permit passage through it of a strap, releasable strap tensioning means mounted on either side of the exterior of said helmet shell, ear cups, a chin strip assembly, an energy-attenuating liner which includes a brow pad, a crown pad and a floating occipital pusher plate suspended from the inside rear aspect of the helmet shell on adjustable strip means which comprises two substantially horizontal straps on either side of the helmet shell consisting of an upper and a lower strip, the lower strap being adjustable as part of the chinstrap assembly and the upper strap being routed to the exterior of the helmet shell through its respective slot on either side of the helmet shell where it is coupled to the releasable strap tensioning means, and wherein the floating occipital pusher plate is operable to urge a wearer's head towards the front of the helmet on tensioning of the adjustable strap means.

6. The protective helmet of claim 5 wherein the upper strap portion of the adjustable strip means on either side of the helmet is routed around the outside of the ear cup on it respective side of the helmet shell such that tensioning of the upper strap on either side causes simultaneous tensioning of the ear cup on that side to bring the ear cup into firm engagement with a wearer's ear.

7. The protective helmet of claim 5 wherein the crown pad comprises a layered composite of expanded polyethylene and open cell foam, said pad being substantially rectangular in shape with a maximum width which permits air flow around the sides of a wearer's head for ventilation.

8. The protective helmet of claim 6 wherein the crown pad comprises a layered composite of expanded polyethylene and open cell foam, said pad being substantially rectangular in shape with a maximum width which permits air flow around the sides of a wearer's head for ventilation.

* * * * *

UNITED STATES PATENT AND TRADEMARK OFFICE

CERTIFICATE OF CORRECTION

PATENT NO. : 5,315,718

DATED : May 31, 1994

INVENTOR(S) : John V. Barson and Roger J. Croft

It is certified that error appears in the above—identified patent and that said Letters Patent is hereby corrected as shown below:

In Column 3, Line 44, delete "$CM^2$" and insert therefor --$cm^2$--.

In Column 4, Line 11, delete "m" and insert therefor --mm--.

In Cclumn 6, Line 19, delete "wheel" and insert therefor --shell--.

In Column 6, Line 36, delete "strip" and insert therefor --strap--.

In Column 6, Line 40, delete "strip" and insert therefor --strap--.

In Column 6, Line 42, delete "strip" and insert therefor --strap--.

Column 6, line 51, delete "strip" and insert therefor --strap--.

Column 6, line 52, delete "it" and insert therefor --its--.

Signed and Sealed this

Sixteenth Day of August, 1994

Bruce Lehman

*Attest:*

BRUCE LEHMAN

*Attesting Officer*

*Commissioner of Patents and Trademarks*